US008677526B2

(12) United States Patent
Li

(10) Patent No.: US 8,677,526 B2
(45) Date of Patent: Mar. 25, 2014

(54) BABY CRIB

(75) Inventor: Jian Qun Li, Central Hong Kong (HK)

(73) Assignee: Wonderland Nurserygoods Company Limited, Hong Kong (HK)

( * ) Notice: Subject to any disclaimer, the term of this patent is extended or adjusted under 35 U.S.C. 154(b) by 288 days.

(21) Appl. No.: 13/184,650

(22) Filed: Jul. 18, 2011

(65) Prior Publication Data

US 2012/0017369 A1 Jan. 26, 2012

(30) Foreign Application Priority Data

Jul. 23, 2010 (CN) ..... 2010 1 0236850

(51) Int. Cl.
*A47D 7/00* (2006.01)

(52) U.S. Cl.
USPC ..... 5/93.1

(58) Field of Classification Search
USPC ..... 5/93.1, 93.2, 95, 101, 108, 655
See application file for complete search history.

(56) References Cited

U.S. PATENT DOCUMENTS

| | | | | |
|---|---|---|---|---|
| RE13,719 | E * | 4/1914 | Taylor | 5/99.1 |
| 5,819,340 | A * | 10/1998 | Kelly | 5/95 |
| 2008/0222810 | A1 | 9/2008 | Epshetsky et al. | |
| 2010/0199426 | A1 | 8/2010 | Long | |

FOREIGN PATENT DOCUMENTS

| | | | |
|---|---|---|---|
| GB | 25385 | | 0/1910 |
| GB | 2421684 | A | 5/2006 |
| TW | 289947 | A4 | 11/1996 |
| WO | 2009049102 | A1 | 4/2009 |

* cited by examiner

*Primary Examiner* — Fredrick Conley
(74) *Attorney, Agent, or Firm* — David I. Roche; Baker & McKenzie LLP

(57) ABSTRACT

A baby crib comprises a support frame and a cradle frame. The support frame includes a hang portion, at least one leg and a base. The hang portion and the base are respectively connected with upper and lower ends of the leg and extend at a same side thereof in two generally parallel planes. The cradle frame is suspended from the hang portion above the base, and is permanently coupled with the hang portion.

17 Claims, 9 Drawing Sheets

BABY CRIB

CROSS-REFERENCE TO RELATED APPLICATION

This application claims priority to Chinese Patent Application No. 201010236850.3 filed on Jul. 23, 2010.

BACKGROUND OF THE INVENTION

1. Field of the Invention

The present invention relates to child carrier apparatuses, and more particularly to baby cribs.

2. Description of the Related Art

A conventional baby crib has a relatively high enclosure. When the child is placed in the baby crib, the height of the enclosure provides a safe environment that can prevent the child from falling outside. However, owing to the height of the enclosure, access to the interior of the baby crib is less inconvenient as the caregiver needs to bow forward to dispense care. While care may be dispensed more conveniently if the caregiver sleeps with the baby, co-sleeping still raises safety concerns, for example the parent may roll on top of the baby.

Therefore, there is a need for an improved baby crib that can be convenient to access for dispensing care, and address at least the foregoing issues.

SUMMARY

The present application describes a baby crib that may be conveniently moved to a bedside for conveniently dispensing care.

In one embodiment, the baby crib comprises a support frame and a cradle frame. The support frame includes a hang portion, at least one leg and a base. The hang portion and the base are respectively connected with upper and lower ends of the leg and extend at a same side thereof in two generally parallel planes. The cradle frame is suspended from the hang portion above the base, and is permanently coupled with the hang portion.

At least one advantage of the baby crib described herein is the ability to impart a swing motion to the cradle frame of the baby crib to comfort the baby received therein. Moreover, the support frame may be adjusted in height, so that the baby crib may be conveniently used at a bedside to conveniently dispense care.

DETAILED DESCRIPTION OF THE EMBODIMENTS

Figure 1:
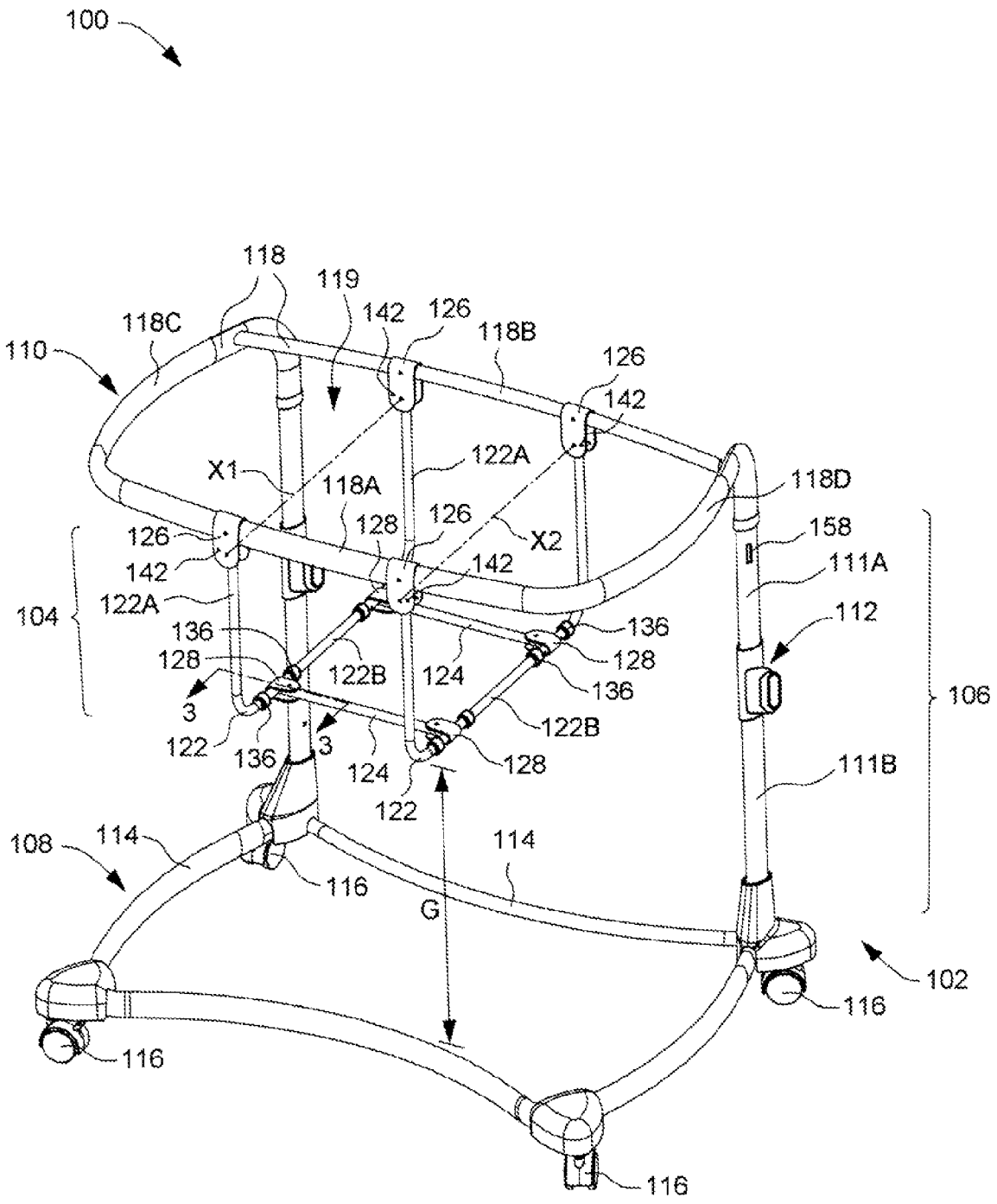
FIG. 1 is a schematic view illustrating one embodiment of a baby crib.
Figure 2:
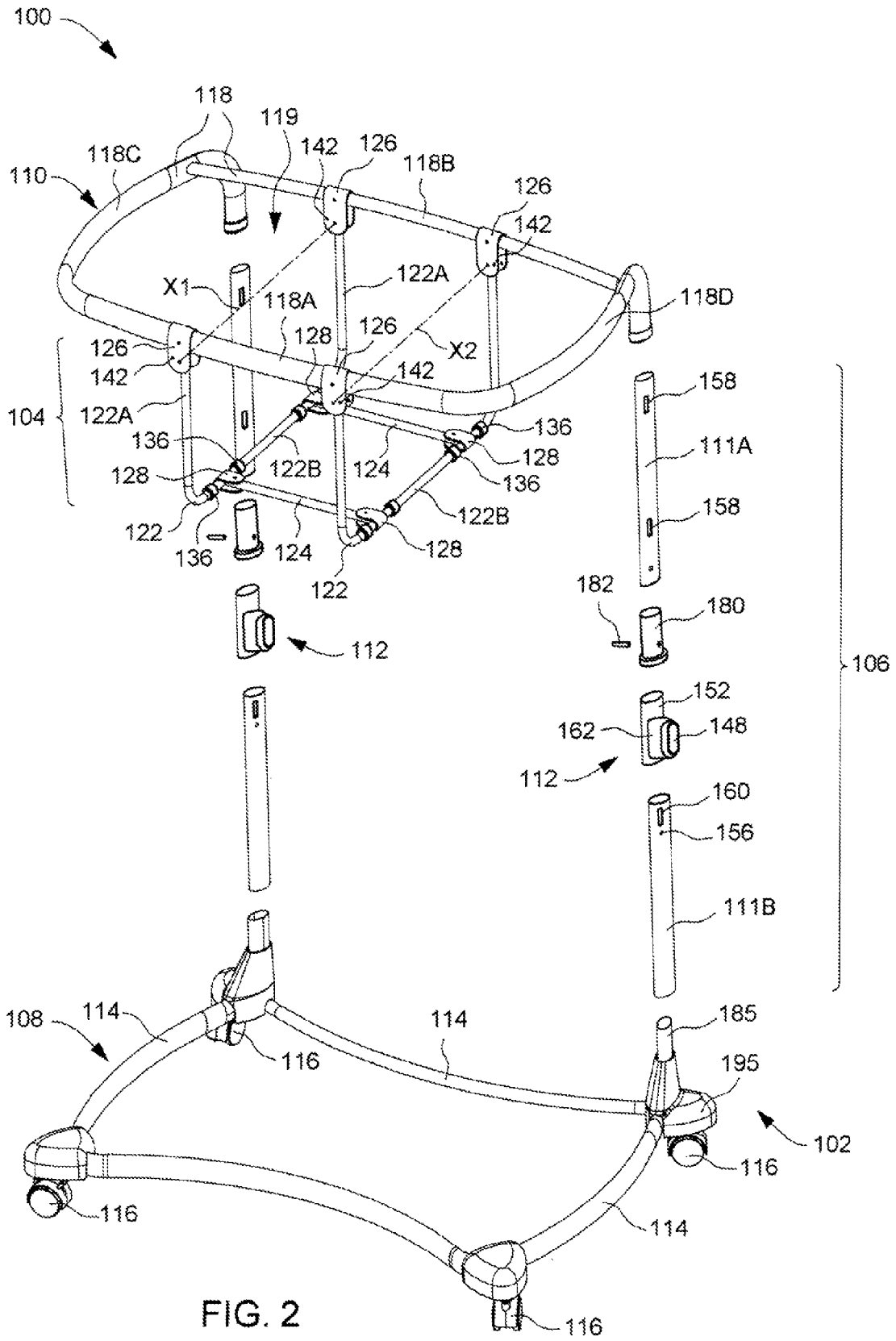
FIG. 2 is an exploded view of the baby crib.

FIGS. 1 and 2 are perspective and exploded views illustrating an embodiment of a baby crib 100. The baby crib 100 can comprise a support frame 102 and a cradle frame 104. The support frame 102 can include one or multiple legs 106, a base 108, and a hang portion 110. In one embodiment, the support frame 102 can comprise two parallel leg segments 106, each of which can be formed from a single or multiple tubes (such as first and second tube segments 111A and 111B shown in FIGS. 1 and 2) assembled together. However, the support frame 102 is not limited to the above structure, and can be constructed to include one or more legs. Moreover, each of the legs 106 can include a height adjustment mechanism 112 operable to modify the overall height of the support frame 102. The base 108 is connected with a lower end of each leg 106, and can include a plurality of tubular segments 114 assembled together in a generally horizontal plane and provided with wheels 116. As shown, the tubular segments 114 may be exemplary assembled to form a base 108 of a quadrilateral shape (for example rectangular). The base 108 can extend laterally at a side of the legs 106. The wheels 116 can be respectively mounted at the four corners of the base 108, while the legs 106 are connected at two neighboring corners of the base 108.

The hang portion 110 can have a rectangular shape formed from the assembly of multiple tubular segments 118, which may include opposite first and second side portions 118A and 118B, and opposite third and fourth side portions 118C and 118D. The first, second, third and fourth side portions 118A, 118B, 118C and 118D surround a central gap 119 of the hang portion 110, which in turn is connected with upper ends of the legs 106 and located at a side of the legs 106 above the base 108. Accordingly, the hang portion 110 and the base 108 respectively extend in two spaced-apart planes approximately parallel to each other for holding the cradle frame 104 in a stable manner.

The cradle frame 104 is permanently assembled with the hang portion 110. In particular, the cradle frame 104 can be suspended from the hang portion 110 above the base 108. In one embodiment, the cradle frame 104 can include a pair of swing arms 122, and a pair of interconnection rods 124. Each of the swing arms 122 can have a generally U-shape including two side segments 122A, and a transverse segment 122B connected with lower ends of the side segments 122A. Upper ends of the two side segments 122A are respectively connected pivotally with the first and second side portions 118A and 118B via brackets 126. The two swing arms 122 are thereby mounted parallel to each other between the first and second side portions 118A and 118B at positions corresponding to the central gap 119.

Each of the interconnection rods 124 has two opposite ends respectively connected with the transverse segments 122B of the two swing arms 122 via connecting joints 128. With this construction, the two interconnection rods 124 are mounted parallel to each other between the two swing arms 122, and a swing motion can be imparted to the two swing arms 122 generally parallel to the first and second side portions 118A and 118B. The swing arms 122 can swing substantially synchronous via the interconnection of the interconnection rods 124.

In the above construction, the cradle frame 104 can have a polygonal shape, all of the legs 106 are located at a same side of the cradle frame 104, and a gap G can be defined between the cradle frame 104 and the base 108. Upper and lower boundaries of the gap G can be respectively defined by a bottom of the cradle frame 104 and the base 108, whereas a lateral boundary of the gap G can be defined by the legs 106. The gap G is opened at a side opposite to that of the legs 106 without any obstructing elements. Accordingly, the baby crib 100 can be placed in overlap over other furniture (such as a sleeping bed) to reduce its occupation space.

Figure 3:
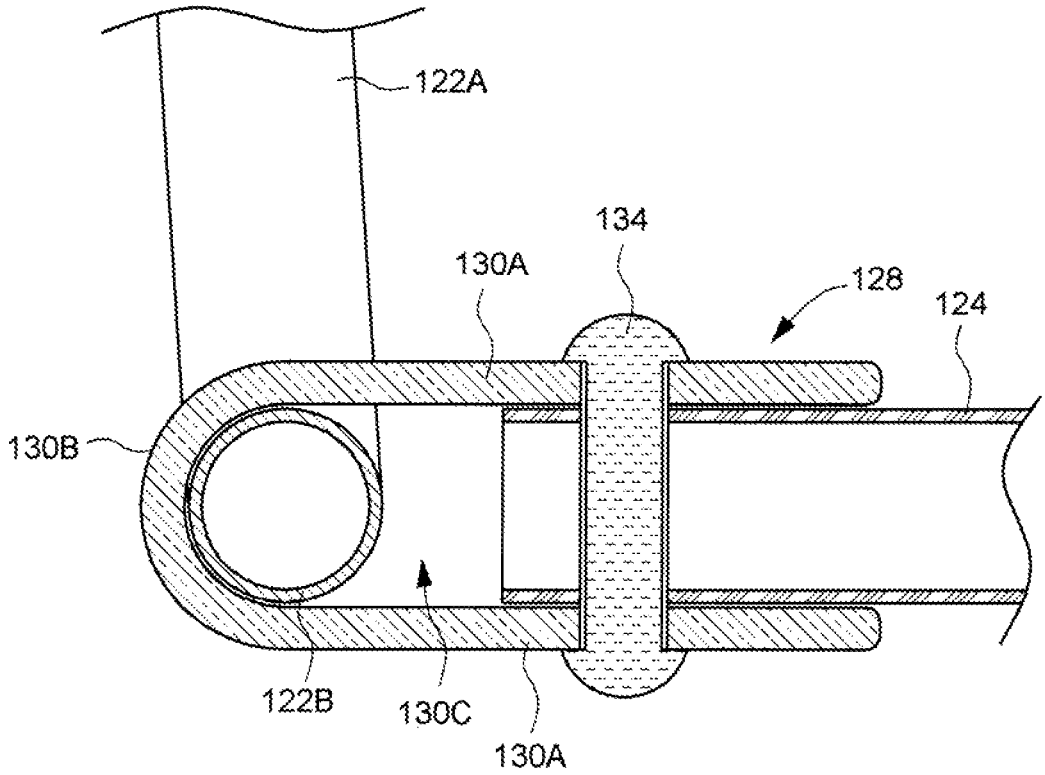
FIG. 3 is a cross-sectional view taken along section 3 shown in FIG. 1 illustrating the assembly of one swing arm with one interconnection rod via in a cradle frame of the baby crib.

FIG. 3 is a cross-sectional view taken along section 3 of FIG. 1 illustrating the assembly of one swing arm 122 with one interconnection rod 124 via one connecting joint 128. The connecting joint 128 can have a generally U-shape including two parallel sidewalls 130A, and an abuttal portion 130B connected between the sidewalls 130A. The transverse segment 122B of the swing arm 122 can be inserted through a gap between the two sidewalls 130A. A distal end of the interconnection rod 124 can be mounted at a spaced-apart position between the two sidewalls 130A and affixed therewith via a fastener element 134 (for example, rivet, screw, and the like). Accordingly, the transverse segment 122B is located in a gap 130C defined between the distal end of the interconnection rod 124 and the abuttal portion 130B. Because the gap 130C is larger than the section of the transverse segment 122B lying therein, the transverse segment 122B can be movable in the gap 130C and also rotate relative to the connecting joint 128. Moreover, restricting elements 136 can be respectively provided on the transverse segment 122B at two opposite sides of the connecting joint 128 to hold the connecting joint 128 in place. The cradle frame 104 thereby formed can receive the placement of various cradle or bassinet bodies. In addition, the cradle frame 104 can also swing relative to the support frame 102 about parallel pivot axes X1 and X2 defined by the brackets 126. In order to limit the range of this swing motion, each of the brackets 126 can be provided with a stop element 142 (such as a rivet or screw) that is passed through the bracket 126. When the cradle frame 104 swings, an upper portion of each side segment 122A can come into contact with the stop element 142 to limit the swing amplitude of the swing arms 122. Discomfort due to excessive swing motion of the cradle frame 104 can be thereby prevented. A cloth or fabric element may also be wrapped and attached with the aforementioned cradle frame 104 to form a cradle enclosure (not shown).

Figure 4:
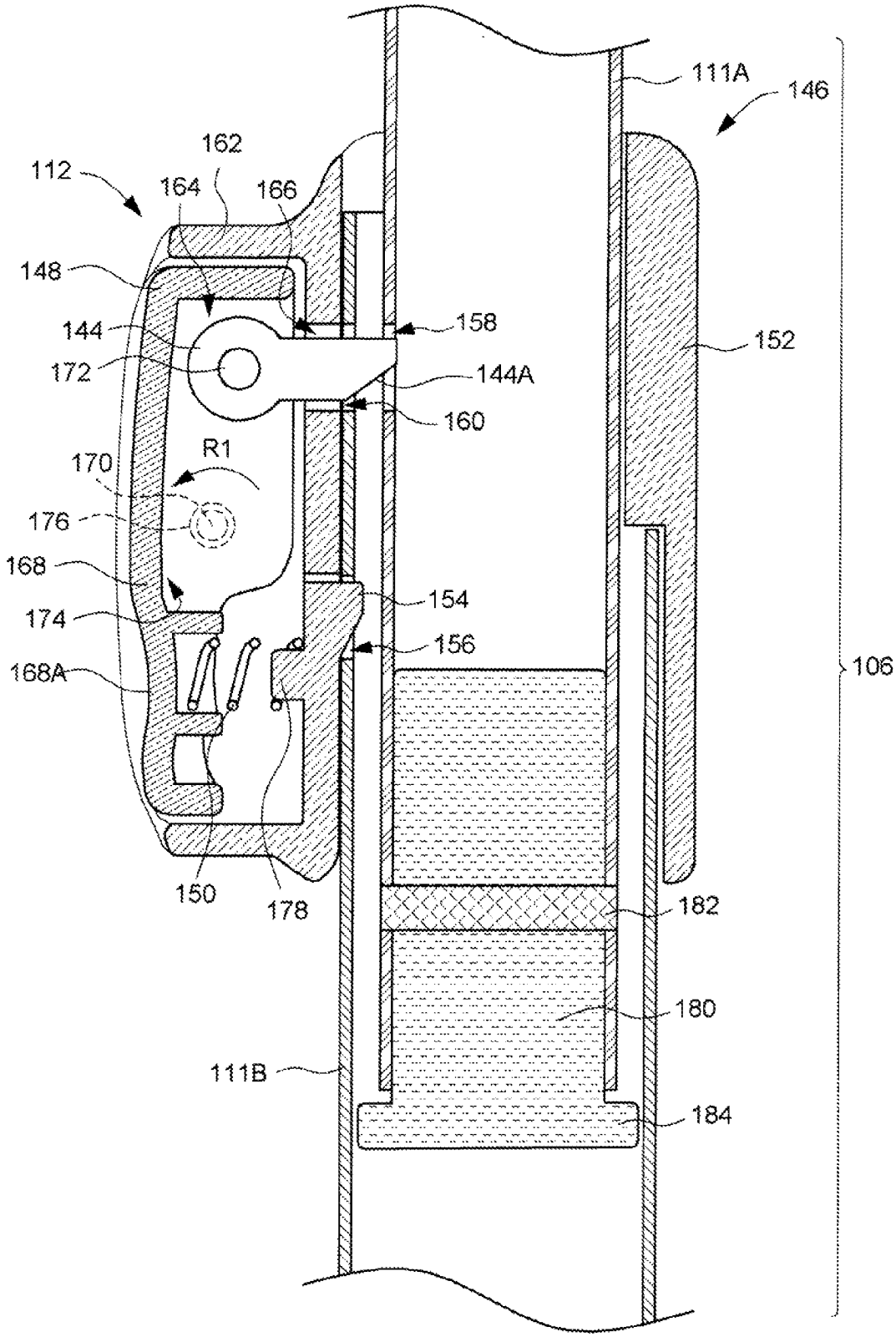
FIG. 4 is a cross-sectional view illustrating a height adjustment mechanism of the baby crib.

In conjunction with FIGS. 1 and 2, FIG. 4 is a cross-sectional view of the height adjustment mechanism 112. Each of the legs 106 can include a first tubular segment 111A movably assembled through a second tubular segment 111B. Being disposed at an overlapping portion between the first and second tubular segments 111A and 111B, the height adjustment mechanism 112 can include a latch element 144, a coupling element 146, a release button 148 and a spring 150. The coupling element 146 can include a sleeve portion 152 having an inner sidewall provided with a protrusion 154. The second tubular segment 111B can include a hole 156 into which the protrusion 154 can engage to secure the sleeve portion 152 around the outer surface of the second tubular segment 111B. Moreover, a plurality of lock positions 158 (for example lock holes) can be formed through the first tubular segment 111A along its axial direction, whereas a hole 160 can be formed through the second tubular segment 111B. The outer surface of the sleeve portion 152 can include a swell portion 162 having an inner cavity 164 in which is mounted the release button 148. A surface of the inner cavity 164 can include a hole 166 that extends to the inner sidewall of the sleeve portion 152, whereby the hollow interior of the sleeve portion 152 communicates with the inner cavity 164 via the hole 166.

The release button 148 can include a button body 168, two pivot studs 170 protruding from two opposite outer surfaces of the button body 168 at symmetrical positions (only one stud 170 is shown with phantom lines in FIG. 4), and a rivet 172. A side of the button body 168 can be recessed to form a pocket 174. The swell portion 162 can include two grooves 176 (only one groove 176 is shown with phantom lines in FIG. 4) into which the studs 170 can respectively engage to define a pivot axis of the release button 148. The rivet 172 can be used to affix the latch element 144 with the button body 168 in the pocket 174. The latch element 144 can pass through the hole 166 of the sleeve portion 152 and the hole 160 of the second tubular segment 111B. The position where the rivet 172 affixes the latch element 144 is vertically higher than the studs 170.

The spring 150A has a first end connected with an anchor rib 178 protruding from a surface of the inner cavity 164, and a second end oppositely connected with an inner surface of the pocket 174. A plunger portion 180 can be inserted through a lower end portion of the first tubular segment 111A, and affixed therewith via a fastener element 182. A lower end portion of the plunger portion 180 can form an annular stop flange 184 that projects radially outward and is located in the second tubular segment 111B. When the first tubular segment 111A slides upward relative to the second tubular segment 111B, the stop flange 184 can come into contact with the protrusion 154 of the coupling element 146 to stop further upward movement of the first tubular segment 111A. Complete separation of the first tubular segment 111A from the second tubular segment 111B can be thereby prevented.

When the height adjustment mechanism 112 is in a locked state, the latch element 144 passes through the hole 160 of the second tubular segment 111B and engages with one of the lock positions 158 on the first tubular segment 111A. The first and second tubular segments 111A and 111B can be thereby locked with each other.

To unlock the height adjustment mechanism 112, a pressure region 168A of the button body 168 can be pressed inward, whereby the release button body 168 can pivot in a direction R1 relative to the coupling element 146. As the button body 168 rotates, the spring 150 is compressed and the latch element 144 is driven in movement to disengage from the lock position 158, which removes the locking engagement between the first and second tubular segments 111A and 111B. The first tubular segment 111A then can be linearly displaced relative to the second tubular segment 111B to adjust the length of the first tubular segment 111A lying in the second tubular segment 111B. An adjustment that increases the length of the first tubular segment 111A in the second tubular segment 111B will reduce the height of the support frame 102, and consequently the vertical height of the cradle frame 104. In contrast, an adjustment that reduces the length of the first tubular segment 111A in the second tubular segment 111B will increase the height of the support frame 102, which consequently increases the gap G and the vertical height of the cradle frame 104.

It is worth noting that the latch element 144 can have a distal end having an angled edge surface 144A facing downward. As the first tubular segment 111A is adjusted upward, an edge surface of the lock position 158 (for example formed by a groove or hole) can contact against the angled edge surface 144A to push the latch element 144 toward the second tubular segment 111B. As a result, the latch element 144 can be displaced to the outside the first tubular segment 111A so as to lie only through the hole 160 of the second tubular segment 111B. In other words, the upward adjustment of the first tubular segment 111A can automatically remove the locking engagement between the first and second tubular segments 111A and 111B, and unlocking operation of the release button 148 may not be necessary.

Figure 5:
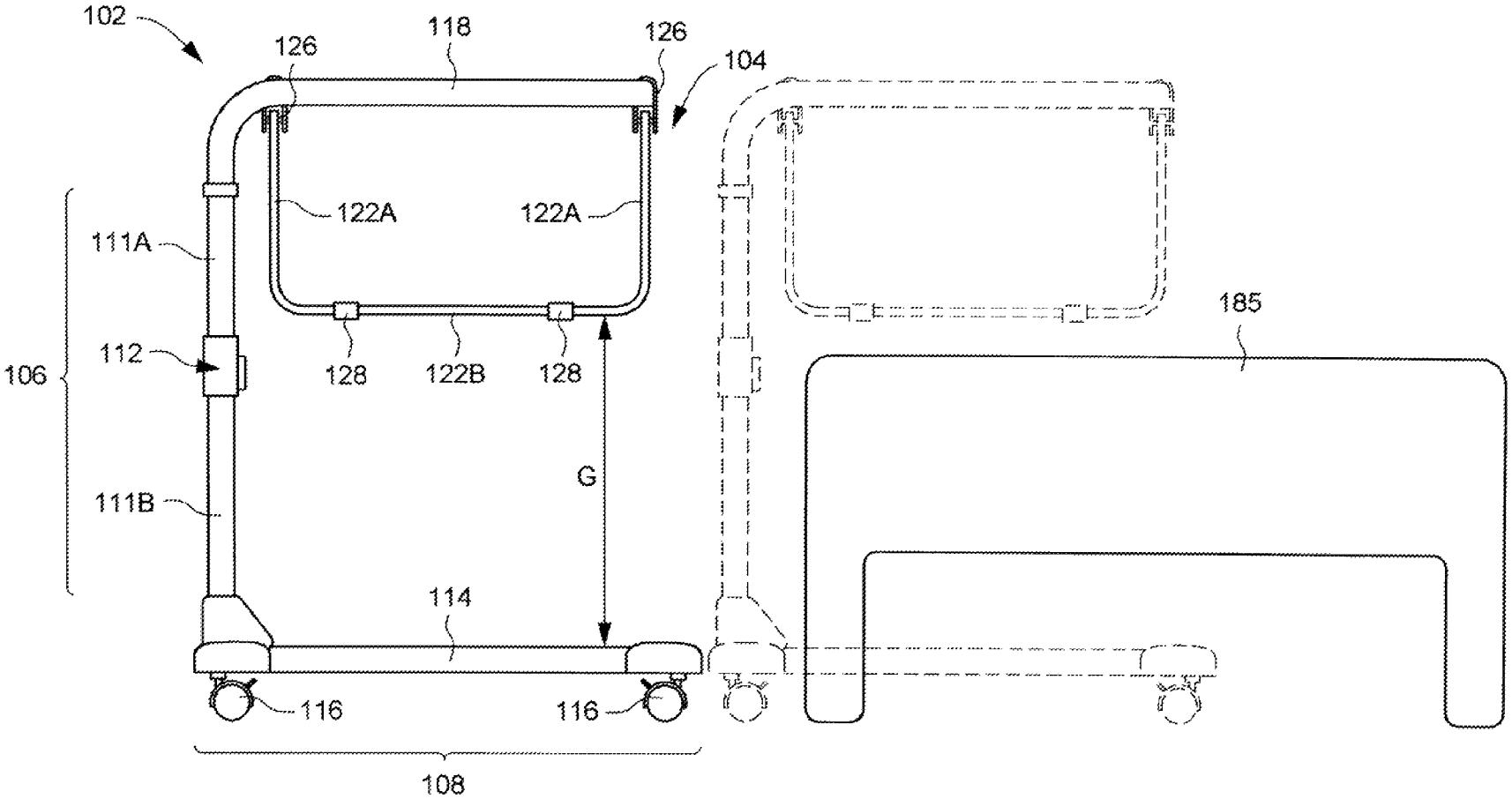
FIG. 5 is a schematic view illustrating the baby crib in a configuration of use at a bedside.

FIG. 5 is a schematic view illustrating the baby crib 100 in a configuration of use at a bedside. The legs 106 can hold the cradle frame 104 at an elevated position so that the caregiver does not need to substantially bow for dispensing care to a child placed in the cradle frame 104. Moreover, the caregiver can operate the height adjustment mechanism 112 to desirably modify the vertical height of the cradle frame 104 relative to the ground, and then conveniently move the baby crib 100 to a side of a sleeping bed 185. The baby crib 100 can be thereby disposed such that the base 108 is positioned below the sleeping bed 185, and a side portion of the sleeping bed 185 is located in the gap G between the cradle frame 104 and the base 108. The cradle frame 104 can also be adjusted so as to correspond to the height of the sleeping bed 185. While being on the sleeping bed 185, the caregiver can conveniently dispense care to the child held in the cradle frame 104.

Figure 6:
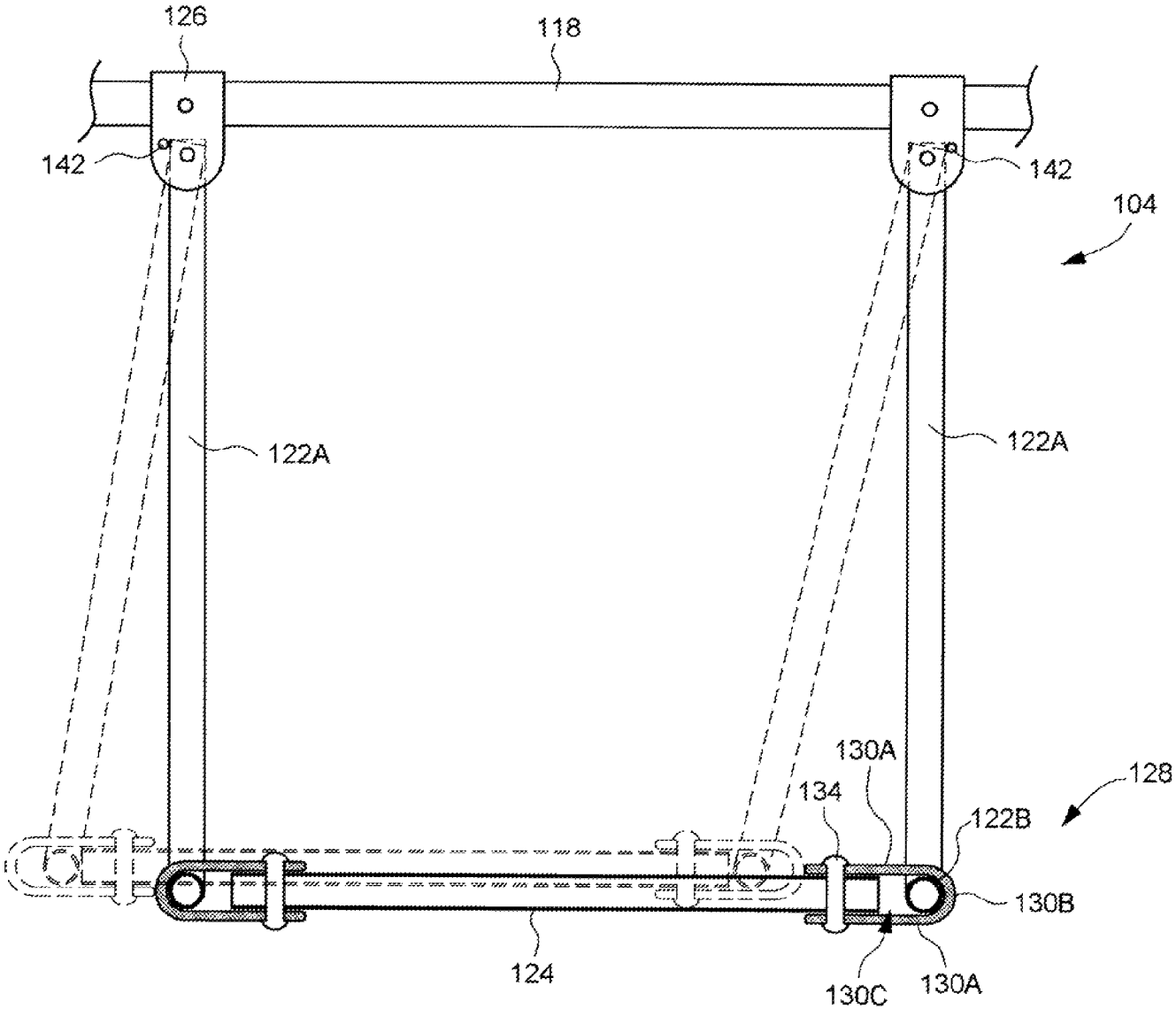
FIG. 6 is a schematic view illustrating a swing motion of a cradle frame of the baby crib.

FIG. 6 is a schematic side view illustrating a swing motion of the cradle frame 104. The cradle frame 104 can be manually driven to perform a swing motion, which can be limited in amplitude by the stop elements 142 of the brackets 126. As the cradle frame 104 swings, the transverse segment 122B of each swing arm 122 can reciprocate in the corresponding gap 130C to alternately contact with the abuttal portion 130B and the distal end of the interconnection rod 124. Accordingly, the interconnection of the interconnection rods 124 can drive the two swing arms 122 in synchronous swing motion.

Figure 7:
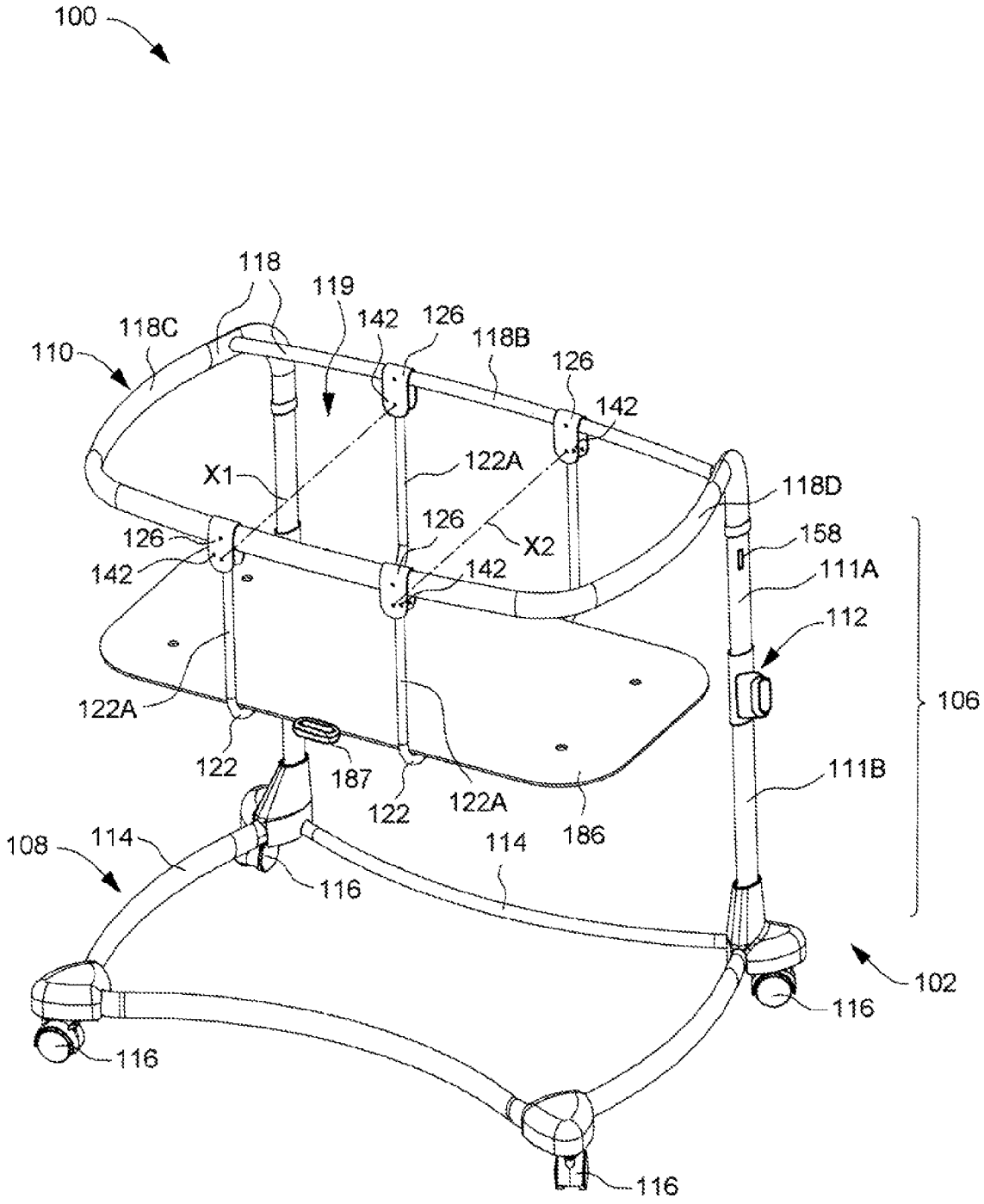
FIG. 7 is a schematic view illustrating a second embodiment of the baby crib.
Figure 8:
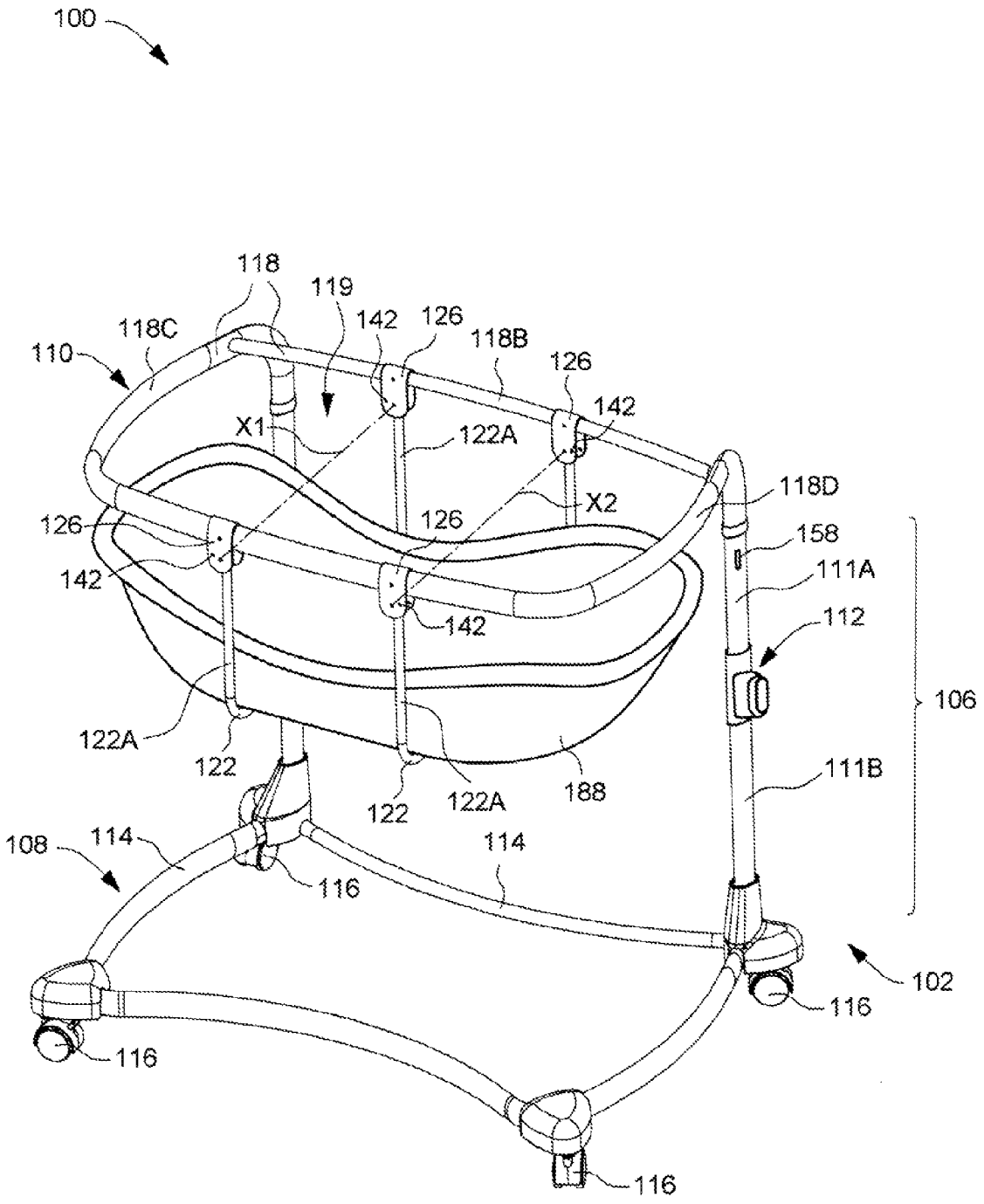
FIG. 8 is a schematic view illustrating a third embodiment of the baby crib.

FIGS. 7 and 8 are schematic views illustrating different variations of the baby crib 100. Compared to the previously described embodiment, the constructions shown in FIGS. 7 and 8 can omit the interconnection of the interconnection rods 124 in the cradle frame, which may replaced with a support board 186 or bassinet 188. A side of the support board 186 may be provided with a handle 187 that can facilitate manipulation of the support board 186. The support board 186 or bassinet 188 can be affixed with or disposed on the transverse segments 122B of the swing arms 122, and is adapted to receive the placement of a portable basket.

Figure 9:
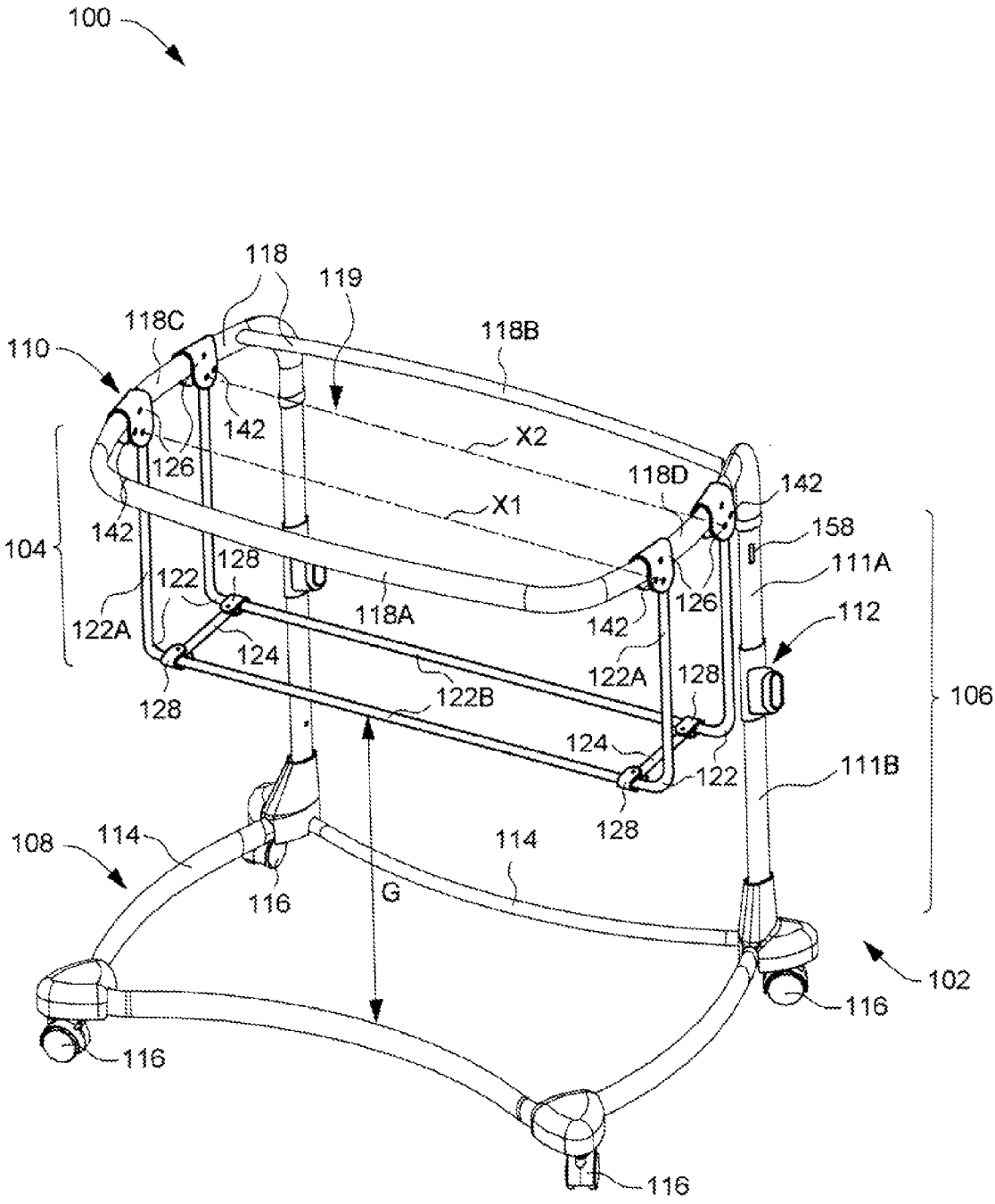
FIG. 9 is a schematic view illustrating a fourth embodiment of the baby crib.

FIG. 9 is a schematic view illustrating another construction of the baby crib 100. In this variant embodiment, the upper ends of the side segments 122A can be pivotally connected with the third and fourth side portions 118C and 118D of the tubular segments 118. Accordingly, the swing arms 122 are disposed parallel to each other between the third and fourth side portions 118C and 118D in the area of the central gap 119. As a result, a swing motion can be imparted to the swing arms 122 parallel to the third and fourth side portions 118C and 118D.

At least one advantage of the structures described herein is the ability to provide a baby crib that is simple in construction, and has a cradle frame that can perform swing motion to comfort a child held therein. Moreover, the baby crib can have a height adjustment mechanism through which the cradle frame can be vertically adjusted to a desirable height for dispensing care in a convenient manner.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A baby crib comprising:

a support frame including a hang portion, at least one leg and a base, wherein the hang portion and the base are respectively connected with upper and lower ends of the leg and extend at a same side thereof in two generally parallel planes, and the hang portion is formed from the assembly of multiple tubular segments, the hang portion including opposite first and second side portions, and opposite third and fourth side portions, the first, second, third and fourth side portions surrounding a central gap of the hang portion; and a cradle frame suspended from the hang portion above the base, wherein the cradle frame is permanently mounted with the hang portion and includes two swing arms, each of the swing arms includes two side segments and a transverse segment connected with lower ends of the side segments, the two side segments of each of the two swing arms have upper ends respectively connected pivotally with the first and second side portions via brackets, whereby the two swing arms are disposed parallel to each other in an area corresponding to the central gap.

2. The baby crib according to claim 1, wherein the support frame includes a plurality of legs placed on a same side of the cradle frame.

3. The baby crib according to claim 1, wherein the base has a quadrilateral shape formed from the assembly of multiple tubular segments, and a plurality of wheels respectively mounted at corners of the quadrilateral shape.

4. The baby crib according to claim 1, wherein the cradle frame further includes a support board or a bassinet placed on the transverse segments of the swing arms.

5. The baby crib according to claim 1, wherein the cradle frame further includes two interconnection rods mounted between the two swing arms, each of the two interconnection rods has two opposite ends respectively connected with the transverse segments of the two swing arms via two connecting joints, whereby the swing arms are movable in a synchronous manner.

6. The baby crib according to claim 5, wherein each of the connecting joints includes two parallel sidewalls, and an abuttal portion connected between the two sidewalls, a distal end of one interconnection rod being affixed between the two sidewalls so that a gap is defined between the abuttal portion and the distal end of the interconnection rod, the transverse segment of one swing arm being assembled between the two sidewalls and operable to move along the gap and rotate therein relative to the connecting joint.

7. The baby crib according to claim 5, wherein each of the connecting joints is mounted between two restricting elements affixed on the associated transverse segment to hold the connecting joint in place.

8. The baby crib according to claim 1, wherein each of the brackets includes a stop element against which one corresponding side segment abuts to limit a swing amplitude of the swing arms.

9. The baby crib according to claim 1, wherein the leg comprises first and second tube segments, the first tube segment being movably mounted through the second tube segment, and a height adjustment mechanism is assembled at an overlap portion of the first and second tube segments and is operable to adjust a length of the first tube segment lying in the second tube segment.

10. The baby crib according to claim 1, wherein the swing arms are operable to swing parallel to the first and second side portions.

11. A baby crib comprising:

a support frame including a hang portion, at least one leg and a base, wherein the hang portion and the base are respectively connected with upper and lower ends of the leg and extend at a same side thereof along two generally parallel planes, and the hang portion includes a first and a second side portion spaced apart from each other; and a cradle frame suspended from the hang portion between the first and second side portions, wherein the cradle frame includes two swing arms, each of the swing arms includes two side segments that have upper ends respectively connected pivotally with the first and second side portions of the hang portion.

12. The baby crib according to claim 11, wherein the swing arms are operable to swing parallel to the first and second side portions.

13. The baby crib according to claim 11, wherein the hang portion is formed from the assembly of multiple tubular segments that surrounds a central gap where the cradle frame is disposed.

14. The baby crib according to claim 11, wherein each of the swing arms includes a transverse segment connected with lower ends of the two side segments thereof.

15. The baby crib according to claim 14, wherein the cradle frame further includes a support board or a bassinet placed on the transverse segments of the swing arms.

16. The baby crib according to claim 14, wherein the cradle frame further includes two interconnection rods mounted between the two swing arms, each of the two interconnection rods has two opposite ends respectively connected with the transverse segments of the two swing arms via two connecting joints, whereby the swing arms are movable in a synchronous manner.

17. The baby crib according to claim 16, wherein each of the connecting joints includes two parallel sidewalls, and an abuttal portion connected between the two sidewalls, a distal end of one interconnection rod being affixed between the two sidewalls so that a gap is defined between the abuttal portion and the distal end of the interconnection rod, the transverse segment of one swing arm being assembled between the two sidewalls and operable to move along the gap and rotate therein relative to the connecting joint.

* * * * *